United States Patent [19]

Gitter

[11] Patent Number: 4,873,966

[45] Date of Patent: Oct. 17, 1989

[54] FOOTREST HAVING HEATING, VIBRATION AND MASSAGING ADJUSTED BY USER'S FEET

[76] Inventor: Michael Gitter, 4 Longfellow Place Apt. 1703, 80 Staniford St., Boston, Mass. 02114

[21] Appl. No.: 135,715

[22] Filed: Dec. 21, 1987

[51] Int. Cl.[4] ..... A61H 23/02; A61H 15/00

[52] U.S. Cl. ..... 128/33; 128/24.3

[58] Field of Search ..... 297/329; 128/24.1, 24.3, 128/24.4, 33

[56] References Cited

U.S. PATENT DOCUMENTS

| | | | |
|---|---|---|---|
| Re. 31,603 | 6/1984 | Christensen | 128/33 |
| 2,521,874 | 9/1950 | Runstedler | 128/33 |
| 2,553,873 | 5/1951 | Schwebel | 128/24.4 |
| 2,792,830 | 5/1957 | Dacey | 128/24.1 |
| 2,949,108 | 8/1960 | Vecchio | 128/24.1 |
| 3,203,415 | 8/1965 | Moore | 128/33 |
| 3,590,812 | 7/1971 | Larson | 128/33 |
| 3,806,193 | 4/1974 | Faiks | 297/325 |
| 4,030,487 | 6/1977 | McEachran | 128/24.1 |
| 4,159,714 | 7/1979 | Peterson | 128/33 |

FOREIGN PATENT DOCUMENTS

| | | | |
|---|---|---|---|
| 513955 | 12/1930 | Fed. Rep. of Germany | 128/24.3 |
| 1311363 | 10/1962 | France | 128/33 |

*Primary Examiner*—Edgar S. Burr
*Assistant Examiner*—Tonya Lamb
*Attorney, Agent, or Firm*—Epstein & Edell

[57] ABSTRACT

A footrest includes a heater, a vibrating motor and massaging rollers in a compact, lightweight panel construction that is selectively positionable on a base over a range of angles relative to horizontal.

18 Claims, 2 Drawing Sheets

FOOTREST HAVING HEATING, VIBRATION AND MASSAGING ADJUSTED BY USER'S FEET

BACKGROUND OF THE INVENTION

1. Technical Field

The present invention relates to footrests and, more particularly, to footrests having a variety of operator-controlled features.

2. Discussion of the Prior Art

It is known in the prior art to provide footrests that can be selectively vibrated to enhance relaxation and user enjoyment. However, in order to incorporate a vibrating mechanism into a footrest, it has been necessary to provide a heavy and/or unwieldy structure that precludes incorporation of other desirable operator-controlled features such as a heater, a wide range of positional adjustability, and a foot massager. Similarly, prior art footrests having built-in heaters typically require a structure that minimizes the effectiveness and/or capacity of the other aforementioned features.

OBJECTS AND SUMMARY OF THE INVENTION

It is therefore an object of the present invention to provide a footrest in a compact, lightweight structure in which selectively actuable heater and vibratory mechanisms are incorporated and which is nevertheless capable of selective adjustment over a wide range of angular positions relative to horizontal.

It is another object of the present invention to provide a footrest of the type described that also incorporates a massaging device for the soles of a user's feet.

In accordance with the present invention a footrest takes the form of a lightweight plastic panel having similar top and bottom parts joined together to define an interior space. Left and right transversely-spaced sections of the panel are disposed on opposite sides of a central section in which the interior space is enlarged in thickness to permit mounting of a vibration mechanism therein. The mechanism includes an electromagnet suspended by a U-shaped bracket secured to the top panel part. The electromagnet induces vibrations in the bracket which transmits the vibrations to the panel in a substantially noiseless manner. The heater takes the form of first and second electrical heater strips arranged in zig-zag planar paths in the left and right panel sections, respectively, and joined in a common circuit by wiring extending across the central section. Rollers mounted on the panel in each of the left and right sections permit the soles of a user's feet to be massaged by moving the feet back and forth over the rollers. The resulting lightweight panel is provided with two longitudinally-extending slots near the transversely-spaced edges of the panel to permit adjustable positioning of the panel on a base member. The base member is adapted to rest on a floor surface and includes two transversely-spaced supports, each having upwardly converging edges adapted to extend through the slots in the panel. Adjustable angular positioning of the panel is achieved by appropriately orienting the panel slots with respect to the received base member supports.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DESCRIPTION OF THE PREFERRED EMBODIMENTS

Figure 1:
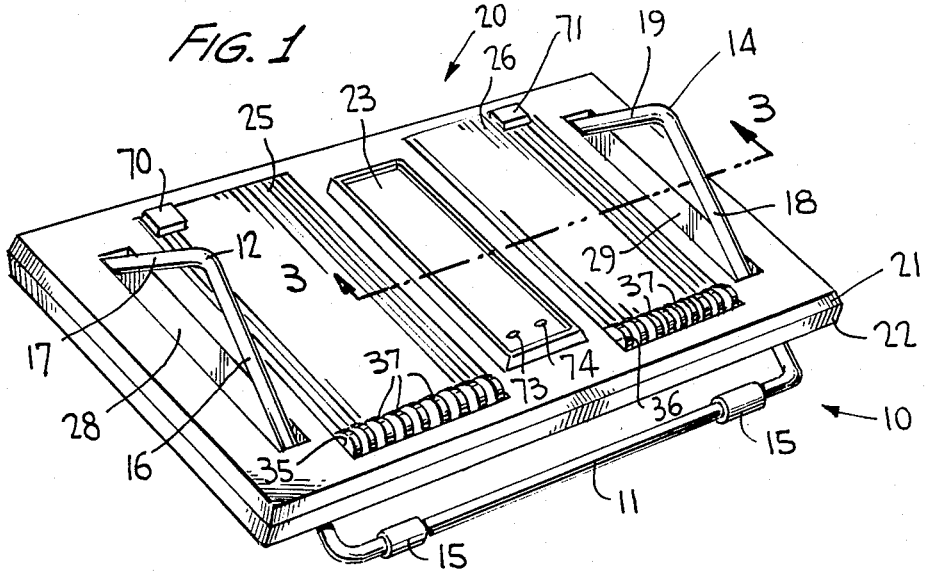
FIG. 1 is a view in perspective of a footrest constructed in accordance with the principles of the present invention.

Definition of Terms:

For purposes of the following description and claims, the following terms shall have the indicated meaning:

(a) "longitudinal" dimension means the dimension of the footrest corresponding to the heel-to-toe orientation of the feet of a person using the footrest;

(b) "width" dimension or "transverse" dimension means the dimension of the footrest orthogonal to and co-planar with the longitudinal dimension; and (c) "thickness" dimension means the dimension of the footrest orthogonal to both the longitudinal and transverse dimensions, i.e., normal to the top surface of the footrest.

Description:

Referring to the drawings in greater detail, the footrest of the present invention includes a base member 10 and a panel 20. Base member 10 in the preferred embodiment takes the form of a rigid frame made up of one or more tubes of chrome-plated steel, or the like, bent and/or joined together to form a continuous frame. The frame includes a near or proximal transversely-extending straight side 11, a bent left side 12 subsisting in a vertical plane extending generally longitudinally, a far or distal transversely-extending straight side 13 parallel to proximal side 11, and a bent right side subsisting in a vertical plane extending generally longitudinally and parallel to the plane containing the left side 12. Proximal side 11 and distal side 13 are adapted to rest on a floor or other flat surface and may be provided with serrated or grooved sleeve sections 15 disposed circumferentially about the tube at various points along the tube lengths to resist any tendency of sides 11 and 13 to slide along the floor. Side 12 is bent to form two straight sections 16, 17 extending from corresponding ends of respective sides 11, 13 to converge at an apex. Similarly, side 14 has two straight sections 18, 19 extending from the other ends of respective sides 11, 13 to converge at an apex. Importantly, sections 16 and 18 are co-planar, and sections 17 and 19 are coplanar. Sides 12 and 14 define supports for the panel 20 in the manner described below.

It will be appreciated, however, that the use of tubes, or a frame-like structure, is not important to the support function; rather, sides 12, 14 may be any structure with converging edges, etc., and still function as required.

Panel 20 is formed from top part 21 and essentially similar bottom part 22. Both panel parts are generally rectangular and have their peripheral sides bent downwardly to provide a peripheral lip. The mutually presented edges of the lips are joined together, by adhesive, ultrasonic welding, or other suitable means, to define an enclosed rectangular interior space peripherally enclosed by the joined edges and defined at its top and bottom by the surrounded interior portions of top part 21 and bottom part 22, respectively.

Figure 2:
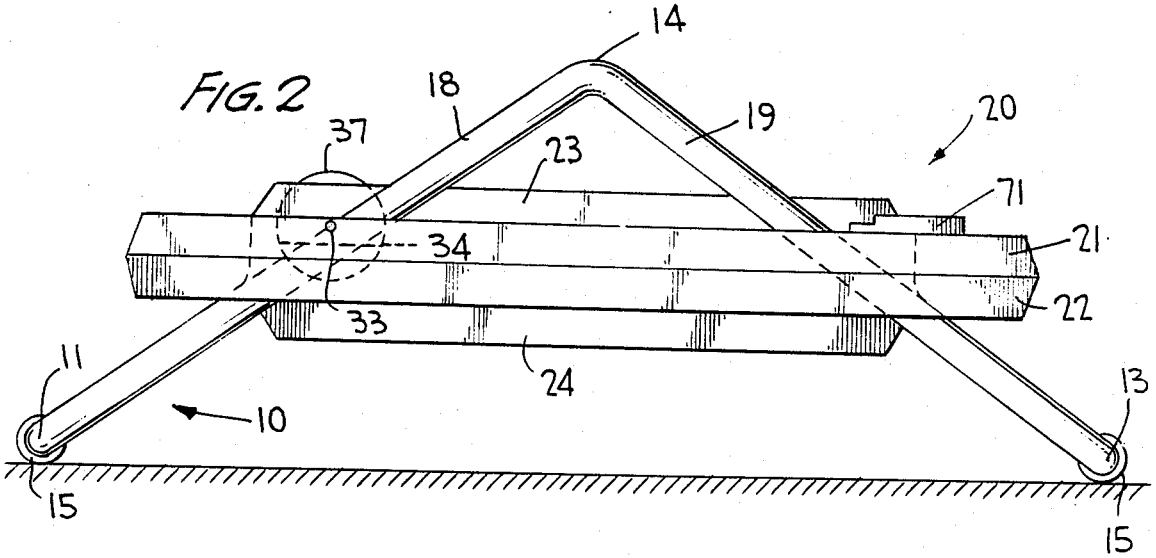
FIG. 2 is a side view in elevation of the footrest of Fig. 1.

Panel parts 21 and 22 are provided with recesses 23 and 24, respectively, located centrally of the panel in both the longitudinal and transverse dimensions. The two recesses 23, 24 are aligned in the panel depth or thickness dimension and provide the interior space with greater depth at the panel center. On transversely opposite sides of recessed central section 23 in panel part 21 there are defined left and right foot-supporting sections 25 and 26. These sections 25 and 26 have multiple longitudinally-extending grooves or recesses 27 defined therein to enhance heat distribution from the heating unit described below. Grooves 27 may be provided in the bottom panel part 22, or not, as desired. At locations transversely outward of left and right foot-supporting sections 25 and 26, top panel part 21 has respective parallel left and right support slots 28 and 29 defined entirely therethrough with their length dimensions extending in the longitudinal dimension of the panel. Corresponding identical slots (only one of which, slot 31, is visible in the drawings; see FIG. 2) are defined in bottom panel part 22 and are aligned with slots 28, 29 to provide slotted apertures extending entirely through the panel at both slot locations. The transverse spacing between the slots 28 and 29 is the same as the spacing between support sides 12 and 14 of base member 10. The width of slots 28, 29, in the transverse dimension of the panel, is sufficient to permit support sides 12, 14, respectively, to be received in the slots so as to extend entirely through the panel with minimal or no slack that might otherwise permit transverse jiggling of the panel relative to its supporting base member. By means of the cooperation between the support sides 12, 14 with their respective slots, a user of the footrest can selectively change the angle of panel 10 relative to horizontal by exerting appropriate force with his/her feet on the panel. For example, to tilt the near or proximal side of the panel downwardly, the user would exert greater force with his/her heels, causing the proximal ends of the slots to ride downwardly on support sections 16, 18, respectively, while the distal ends of the slots ride upwardly on support sections 17, 19. It will be evident that greater force exerted on the distal half of the panel causes the panel to move in an opposite direction. The user can thus easily position the panel at a comfortable angle by merely exerting the appropriate force with his/her feet. It is important to note that the positional adjustability of the panel is provided without adding any structure or mass to the panel; rather, the lightweight panel is rendered positionally adjustable by means of the removal of panel material to form the slots 28, 29.

Top panel part 21 is also provided with generally rectangular cut-out portions 35, 36 defined therethrough near the proximal ends of left and right foot-receiving sections 25, 26, respectively. The longer dimension of cut-outs 35, 36 extends transversely of the panel along substantially the entire width of the corresponding foot-receiving section. At each end of the cut-outs 35, 36 there is a depending lip 34 (FIG. 2) apertured to receive a rod 33 secured in place at such aperture in both lips 34 of the cut-out. Plural roller members 37 are disposed transversely along the rod 33 and are individually rotatable about the rod when tangential forces are applied to the rollers by the soles of a user's foot passing over them. In this regard, the diameter of the rollers must be sufficient to permit at least a portion of them to project radially out from the cut-out and above the top surface of the panel. The movement of the soles of user's feet over rollers 37 provides a massaging effect that stimulates blood circulation and creates a soothing feeling. Instead of multiple rollers, a single roller may be utilized at each cut-out. Moreover, rod 33 may be journaled in the apertured depending lips 34 so as to be rotatable, in which case the rollers would be fixed to the rod and rotate therewith.

Figure 3:
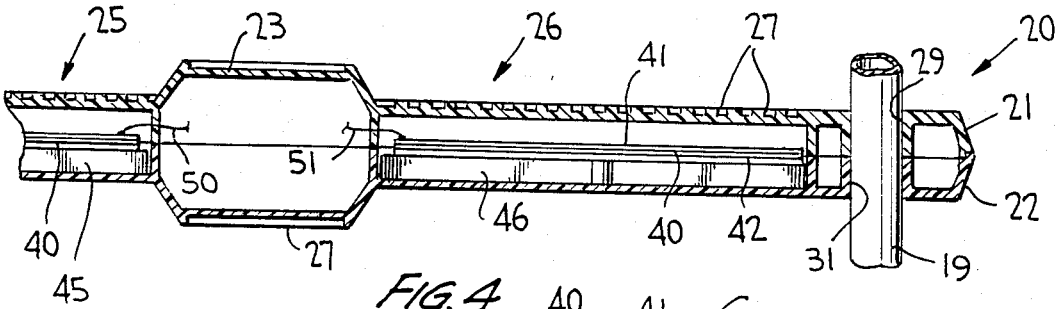
FIG. 3 is a view in section taken along lines 3—3 of FIG. 1.
Figure 4:
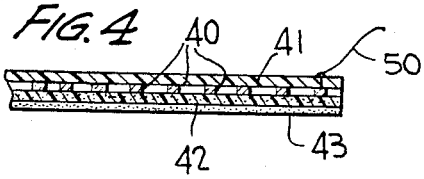
FIG. 4 is a detailed view in section of a portion of the heater element illustrated in FIG. 3.
Figure 5:
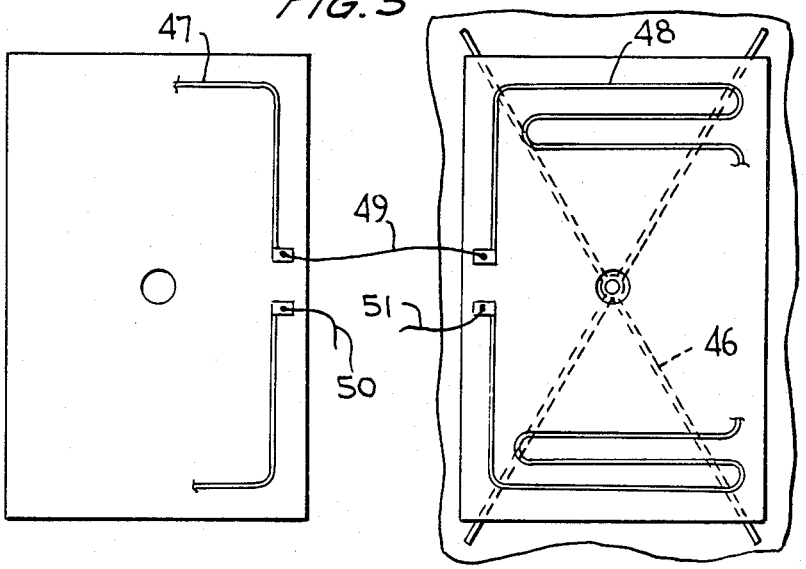
FIG. 5 is partially schematic broken top view in plan of the footrest of FIG. 1 illustrating the layout of the heater element.
Figure 6:
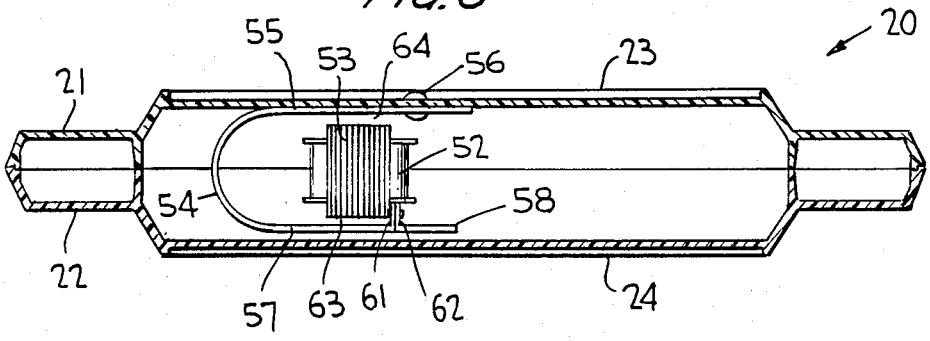
FIG. 6 is a sectional view in elevation of the center portion of the panel illustrating the mounting for the vibration motor.
Figure 7:
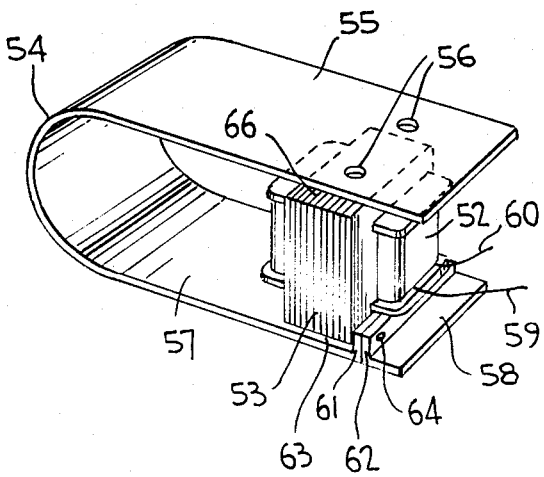
FIG. 7 is a view in perspective of the vibration motor illustrated in FIG. 6.

The heater for the footrest is an electrical resistance heater mounted in the interior panel space and is best illustrated in FIGS. 3, 4 and 5. The heating element is an elongated thin film 40 of electrically conductive material (such as copper, aluminum, Inconel on Nomex a suitable alloy, etc.) laid out in a planar tortuous path beneath left and right foot-receiving sections 25, 26 so as to evenly distribute the heat dissipated by the film over these sections. The film is sandwiched between two electrically insulative but thermally conductive substrates 41, 42, one of which has an adhesive compound 43 on its outer surface to secure the sandwiched heater structure in place. In this regard, rib structures 45, 46 extend from bottom panel part 22 into the interior space and provide support surfaces or edges to which the adhesive compound 43 can be secured. Ribs 45, 46 are oriented so that the planar sandwiched structure 40, 41, 42 is parallel to and spaced from the top panel part 21. In the preferred embodiment the required tortuous path of the elongated thin film takes the form of two zig-zag patterns 47, 48 below the left and right foot-receiving sections 25, 26, respectively. As illustrated, each leg of the zig-zag path extends transversely of the panel with the legs being longitudinally spaced. This arrangement could, of course, be reversed so that the legs extend longitudinally and are transversely spaced; or, any other tortuous path may be employed as long as the heat dissipated by the current passing through the thin film 40 is distributed over substantially all of the foot-receiving sections 25, 26. A jumper wire 49 extends across the central section and connects both zig-zag patterns 47, 48 in a series circuit. Lead wires 50, 51 connect the series circuit to a switch and power source as described below. Thickness of the heater film is selected such that for a given applied voltage the current through the film, and therefore the dissipated heat, is fixed. This does away with the need for a temperature override protection device.

A vibrating mechanism is also mounted in the interior space of the panel. The vibrating mechanism includes a U-shaped bracket 54 having a first leg 55, the outer surface of which is mounted flush against the underside of top panel member 21 at central recess 23 by means of rivets 56, screws, adhesive, or the like. The opposite leg of bracket 54 is formed from longitudinally sequential segments, namely proximal segment 57 and distal segment 58, joined at abutting bent flanges 61, 62 extending inwardly from the leg. An electromagnet includes a core 53 made up of multiple laminations, and a coil 52 wound about one leg of the core and connected to be selectively excited by 115 volts 60 Hz primary power by means of wires 59, 60. Core 53 is preferably E-shaped and secured by screws 64, or the like, along its long side to the flange 61 of leg segment 57. When so mounted the core is spaced a small distance from the longitudinally-extending part of segment 57 to form a small gap 63. A considerably larger gap 66 exists between core 53 and leg 55 of bracket 54. The electromagnet is thus suspended in the interior space of the panel 20 by bracket 54 having its leg 55 mounted flush against upper panel part 21 at recess 23. When alternating current is passed through coil 62, the resulting alternating field in core 53 tends to alternately attract and repel bracket leg 55 with respect to the core. The resulting vibratory motion is transmitted by bracket leg 55 to the top panel part 21 and is readily sensed at the soles of feet placed on foot-receiving sections 25, 26. The flush mounting of bracket leg 55 on panel part 21, combined with the floating suspension of the electromagnet, permits the vibrations to be effected with minimal noise.

A vibration control switch 70 is mounted in top panel part 21 at the upper left corner of left foot-receiving section 25. Switch 70 is preferably of the push-button type with three different positions, namely "LO" (single depression), "HI" (two depressions) and "OFF" (three depressions, i.e., released). The LO and HI positions produce low level and high level amplitude vibrations, respectively, from the vibrating mechanisms. If desired, only one vibration amplitude may be incorporated into the design, in which case switch 70 would be a two-position switch.

A heater control switch 71 is mounted in top panel part 22 at the upper right corner of right foot-receiving section 26. Switch 71 is preferably of the push-button type with two different positions, namely "ON" (single depression) and "OFF" (two depressions, i.e., released). Switch 70 and switch 71 are easily actuated (i.e., depressed) by the foot of a user of the device and are connected to the vibrator mechanism and heater in the manner described below in relation to the schematic diagram of FIG. 8.

A vibration indicator lamp 72 is mounted proximate the lower left corner of central section 23 of top panel part 21. Lamp 73 is lit whenever the vibrator mechanism is actuated. A heater indicator lamp 74 is mounted proximate the lower right corner of central section 23 of and is lit when current passes through the heater element 40.

Figure 8:
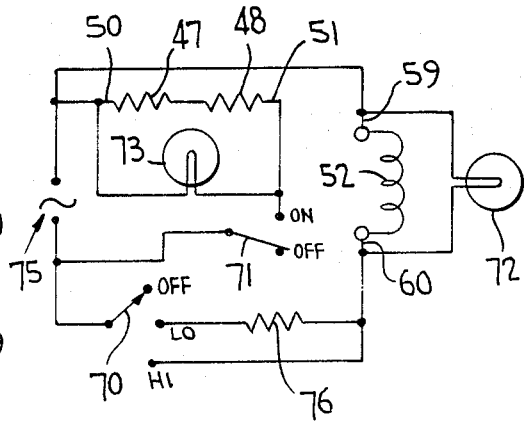
FIG. 8 is an electrical schematic diagram of the circuitry utilized to actuate the motor and heater in the footrest.

Referring to FIG. 8, 115 volts, 60 Hz primary power is applied to the unit by means of a common appliance power plug 75. One leg of the primary power is connected to lead wire 59 of coil 52 and to lead wire 50 of heater section 47. The other primary power leg is connected to the common contact of vibration control switch 70 and the common contact of heater control switch 71. The HI contact of switch 70 is connected directly to lead wire 60 of coil 52; the LO contact of that switch is coupled to lead wire 60 through a voltage-dropping resistor 76. Vibration indicator lamp 72 is connected directly across coil 52. The ON contact of switch 71 is connected to lead wire 51 of heater section 48.

In operation, when neither of switches 70, 71 is depressed, no current passes through the circuit of FIG. 8 so that neither the vibrator mechanism nor the heater is actuated. A single depression of vibrator control switch 70 permits current to pass through vibrator coil 72 via voltage-dropping resistor 76 to cause the coil to be actuated at low amplitude. Current also passes through lamp 72 which is thereby illuminated. Coil 52 produces the low level vibrations in the panel in this position of the switch. A second depression of switch 70 places that switch in the HI position in which current through coil 52 and lamp 72 bypasses the voltage-dropping resistor, thereby producing higher amplitude vibrations. A third depression of switch 70 places that switch in its OFF position, opening the current path for the coil 52 and turning off the vibrator.

Depression of switch 71 permits current to pass through both sections 47, 48 of the heater, in series, and through the lamp 73, via the ON contact of switch 71. The heater is thus energized and its dissipated heat is distributed over both the left and right foot-receiving sections 25, 26 of the panel. Heater lamp 73 is also energized at this time. Further depression of switch 71 returns that switch to its OFF position in which the heater is no longer actuated.

By way of example only, a preferred embodiment of the present invention may be constructed using the following dimensions, parameters and components:

| Component | Value |
|---|---|
| Length of panel 20 | 12 inches |
| Width of panel 20 | 18.68 inches |
| Depth of panel 20 (outside recesses 23, 24) | 1.0 inches |
| Depth of each recess 23, 24 | 0.5 inches |
| Length of each recess 23, 24 | 8.0 inches |
| Width of each recess 23, 24 | 2.25 inches |
| Length of each foot-receiving section 25,26 | 9.50 inches |
| Width of each foot-receiving section 25,26 | 5.50 inches |
| Longitudinal dimension of cut-outs 35, 36 | 1.00 inches |
| Transverse dimension of cut-outs 35, 36 | 5.50 inches |
| Material thickness for panel parts 21, 22 | 0.100 inches |
| Length of bracket leg 55 | 3.25 inches |
| Length of bracket segment 57, 58 | 2.750 inches |
| Width of bracket legs 55 and 57, 58 | 1.375 inches |
| Distance between bracket legs | 1.094 inches |
| Length of base member 10 | 13.81 inches |
| Width of base member 10 | 16.75 inches |
| Gap 63 | 0.063 inches |
| Gap 64 | 0.219 inches |
| Angle between sections 16 and 17 (also 18 and 19) | 110° |
| Tubing O.D. for base member 10 | 0.5 inches |
| Length of slots 28, 29 | 7.625 inches |
| Width of slots 28, 29 | 0.625 inches |
| Vibrator - (Model VC-375H, Endicott Coil Corp. Binghamton, New York) | |
| Heater resistance (nominal) | 410 ohms |
| Heater power (nominal) | 32 watts |
| Heater element (2 pcs) | $5\frac{5}{8}$ inches × $7\frac{1}{8}$ inches EAC |

From the foregoing description it will be appreciated that the invention makes available a novel footrest incorporating a selectively actuable vibrating mechanism, a selectively actuable heater and a massaging member, all in a sufficiently lightweight and compact structure that can be selectively positionable over a wide range of angles relative to horizontal.

Having described a preferred embodiment of a new and improved footrest constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed:

1. A footrest comprising:

a panel having a top part with a footrest surface;

support means for movably mounting said panel to permit adjustable angular positioning of said top surface relative to horizontal;

vibrator means mounted inside said panel and responsive to application of voltage thereto for imparting vibration to said top surface;

selectively actuable vibration switch means mounted on said top part for selectively applying voltage to said vibrator means;

electrical heater means mounted inside said panel and responsive to passage of current therethrough for heating said top surface;

selectively actuable heater switch means mounted on said top part for selectively passing current through said heater means; and massaging means for stimulating circulation in the soles of the feet of a user of said footrest, said massaging means comprising at least one roller member mounted on said panel for rotational movement about an axis extending substantially parallel to said top surface, said roller projecting at least partially above said top surface to permit selective rotation thereof by said user moving a foot along said top surface past said roller;

wherein said panel has: a length dimension corresponding to the heel-to-toe direction along which the feet of a user extend when using the footrest; a width dimension extending transversely of said length dimension; and a thickness dimension perpendicular to and very much smaller than both said length and width dimensions; said panel having first and second transversely spaced mounting slots defined entirely through said thickness dimension and extending lengthwise along most of said length dimension; and wherein said support means comprises:

a frame having a base portion adapted to rest on a floor surface and two upstanding transversely-spaced supports having the same transverse spacing as said slots in said panel, each support including first and second upwardly converging edges having a lengthwise spacing near said base that is greater than the length of said slots, and a lengthwise spacing near the support top that is smaller than the length of said slots, each support having a transverse dimension no greater than the width of said slots in order to permit a top portion of each support to fit through a respective slot, whereby said panel can be selectively tilted at different angles relative to horizontal by selectively positioning said slots relative to said first and second edges of said supports.

2. The footrest according to claim 1 wherein said heater means comprises an electrically conductive heating element disposed inside said panel and extending along a zig-zag path encompassing most of the area of said top surface.

3. The footrest according to claim 2 wherein said vibrator means comprises:

a generally U-shaped bracket having a first leg mounted inside said panel on the underside of said top part, and a second leg suspended from said top part; and a selectively energizable electromagnet mounted on said second leg to induce vibrations in said first leg of said bracket.

4. The footrest according to claim 3 wherein said top part includes first and second sections disposed substantially symmetrically on opposite transverse sides of a raised central portion;

wherein said at least one roller member is mounted at said first section, said massaging means further including a second roller member substantially identical to said at least one roller member and mounted at said second section;

wherein said heater means includes first and second segments of said electrically conductive heating elements disposed beneath said first and second sections, respectively of said top part and electrically connected by electrical wiring extending across said central portion; and wherein said bracket is mounted at said central portion.

5. The footrest according to claim 1 wherein said motor means comprises:

a generally U-shaped bracket having a first leg mounted inside said panel on the underside of said top part, and a second leg suspended from said top part; and a selectively energizable electromagnet motor mounted on said second leg to impart vibrations to said first leg of said bracket.

6. The footrest according to claim 1 wherein said motor means comprises:

a generally U-shaped bracket having a first leg mounted inside said panel on the underside of said top part, and a second leg suspended from said top part; and a selectively energizable electromagnet mounted on said second leg to impart vibrations to said first leg of said bracket.

7. A footrest comprising:

a panel having a top part with a footrest surface;

support means for movably mounting said panel to permit adjustable angular positioning of said top surface relative to horizontal;

vibrator means mounted inside said panel and responsive to application of voltage thereto for imparting vibration to said top surface;

selectively actuable vibration switch means mounted on said top part for selectively applying voltage to said vibrator means;

electrical heater means mounted inside said panel and responsive to passage of current therethrough for heating said top surface; and selectively actuable heater switch means mounted on said top part for selectively passing current through said heater means;

wherein said panel has: a length dimension corresponding to the heel-to-toe direction along which the feet of a user extend when using the footrest; a width dimension extending transversely of said length dimension; and a thickness dimension perpendicular to and very much smaller than both said length and width dimensions; said panel having first and second transversely spaced mounting slots defined entirely through said thickness dimension and extending lengthwise along most of said length dimension; and wherein said support means comprises:

a frame having a base portion adapted to rest on a floor surface and two upstanding transversely-shaped supports having the same transverse spacing as said slots in said panel, each support including first and second upwardly converging edges having a lengthwise spacing near said base that is greater than the length of said slots, and a lengthwise spacing near the support top that is smaller than the length of said slots, each support having a transverse dimension no greater than the width of said slots in order to permit a top portion of each support to fit through a respective slot, whereby said panel can be selectively tilted at different angles relative to horizontal by selectively positioning said slots relative to said first and second edges of said supports.

8. The footrest according to claim 7 wherein said heater means comprises an electrically conductive heating element disposed inside said panel and extracting along a zig-zag path encompassing most of the area of said top surface.

9. The footrest according to claim 8 wherein said motor means comprises:

a generally U-shaped bracket having a first leg mounted inside said panel on the underside of said top part, and a second leg suspended from said top part; and a selectively energizable electromagnet mounted on said second leg to impart vibrations to said first leg of said bracket.

10. The footrest according to claim 7 wherein said motor means comprises:

a generally U-shaped bracket having a first leg mounted inside said panel on the underside of said top part, and a second leg suspended from said top part; and a selectively energizable electromagnet mounted on said second leg to impart vibrations to said first leg of said bracket.

11. A footrest comprising:

a panel having: a length dimension corresponding to the heel-to-toe direction along which the feet of a user extend when using the footrest; a width dimension extending transversely of said length dimension and extending across the side-to-side direction of the feet of a user of the footrest; and a thickness dimension perpendicular to and very much smaller than said length and width dimensions;

wherein said panel includes top and bottom parts enclosing a component-mounting space inside said panel, said top part having an outer surface constituting a footrest surface adapted to receive the feet of a user;

support means responsive to the magnitude and location of forces applied by the feet of the user in a direction perpendicular to said footrest surface for selectively adjusting the angular orientation of said panel relative to horizontal;

vibrator means mounted entirely within said component-mounting space and responsive to application of voltage thereto for imparting vibration to said footrest surface;

selectively actuable vibration switch means mounted on said panel for selectively applying voltage to said vibrator means;

electrical heater means mounted entirely within said component-mounting space and responsive to passage of current therethrough for heating said footrest surface;

and selectively actuable heater switch means mounted on said panel for selectively passing current through said heater means.

12. The footrest according to claim 11 wherein said heater means comprises an electrically conductive heating element disposed inside said panel and extending along a zig-zag path.

13. The footrest according to claim 11 wherein said footrest surface includes first and second generally coplanar area sections straddling a raised portion substantially centered width-wise of said panel, wherein said first and second area sections are adapted to receive two feet, respectively, of a user of the panel, wherein said vibrator means is disposed beneath and secured to said raised portion, and wherein said heater means is disposed beneath said first and second area sections.

14. The footrest according to claim 13 wherein said thickness dimension is on the order of two inches at the thickest part of said panel.

15. The footrest according to claim 13 wherein said top and bottom parts are lightweight plastic material and have substantially similar configurations, each part having a peripheral lip, the peripheral lips of the top and bottom parts extending toward and abutting one another in sealed relation to enclose said component-mounting space.

16. The footrest according to claim 13 wherein said heater means comprises an electrically conductive heating element disposed entirely within said component-mounting space and extending along a zig-zag path encompassing most of the area beneath said first and second area sections.

17. The footrest according to claim 13 wherein said vibrator means comprises:

a generally U-shaped bracket having a first leg mounted inside said panel on the underside of said raised portion, and a second leg suspended from said raised portion; and a selectively energizable electromagnetic motor mounted on said second leg to impart vibration to said first leg of said bracket.

18. The footrest according to claim 13 wherein said panel includes first and second transversely-spaced mounting slots defined entirely through said thickness dimension and extending lengthwise along most of said length dimension, and wherein said support means comprises:

a frame having a base portion adapted to rest on a floor surface and two upstanding transversely-space supports having the same transverse spacing as said slots in said panel, each support including first and second upwardly converging edges having a lengthwise spacing near said base that is greater than the length of said slots, and a lengthwise spacing near the support top that is smaller than the length of said slots, each support having a transverse dimension no greater than the width of said slot in order to permit a top portion of each support to fit through a respective slot, whereby said panel can be selectively tilted at different angles relative to horizontal by selectively positioning said slots relative to said first and second edges of said supports.

* * * * *